US005366519A

United States Patent [19]

Cherpeck

[11] Patent Number: 5,366,519

[45] Date of Patent: Nov. 22, 1994

[54] FUEL ADDITIVE COMPOSITIONS CONTAINING POLY(OXYALKYLENE) HYDROXYAROMATIC ESTERS AND POLY(OXYALKYLENE) AMINES

[75] Inventor: Richard E. Cherpeck, Cotati, Calif.

[73] Assignee: Chevron Research and Technology Company, San Francisco, Calif.

[21] Appl. No.: 993,174

[22] Filed: Dec. 18, 1992

[51] Int. Cl.[5] ..... C10L 1/22

[52] U.S. Cl. ..... 44/400; 44/389

[58] Field of Search ..... 44/388, 387, 386, 385, 44/400, 389; 560/61, 63, 103

[56] References Cited

U.S. PATENT DOCUMENTS

| | | | |
|---|---|---|---|
| 2,800,400 | 7/1957 | Hughes | 44/400 |
| 2,956,870 | 10/1960 | Heisler et al. | 44/389 |
| 3,758,282 | 9/1973 | Owen et al. | 44/391 |
| 3,849,085 | 11/1974 | Kreuz et al. | 44/78 |
| 3,944,594 | 3/1976 | Kleiner et al. | 44/383 |
| 4,134,846 | 1/1979 | Machleder et al. | 252/51.5 |
| 4,160,648 | 7/1979 | Lewis et al. | 44/63 |
| 4,191,537 | 3/1980 | Lewis et al. | 44/71 |
| 4,197,409 | 4/1980 | Lilburn | 560/158 |
| 4,236,020 | 11/1980 | Lewis et al. | 560/159 |
| 4,243,798 | 1/1981 | Franklin et al. | 528/371 |
| 4,245,030 | 1/1981 | Faust et al. | 430/281 |
| 4,247,301 | 1/1981 | Honnen | 44/63 |
| 4,261,704 | 4/1981 | Langdon | 44/62 |
| 4,270,930 | 6/1981 | Campbell et al. | 44/71 |
| 4,274,837 | 6/1981 | Lilburn | 44/63 |
| 4,281,199 | 7/1981 | Langdon | 564/475 |
| 4,288,612 | 9/1981 | Lewis et al. | 560/159 |
| 4,329,240 | 5/1982 | Lilburn | 252/51.5 |
| 4,332,595 | 6/1982 | Herbstman et al. | 44/72 |
| 4,604,103 | 8/1986 | Campbell | 44/72 |
| 4,778,481 | 10/1988 | Courtney | 44/57 |
| 4,881,945 | 11/1989 | Buckley, III | 44/72 |
| 5,055,607 | 10/1991 | Buckley, III | 560/158 |
| 5,094,667 | 3/1992 | Schilowitz et al. | 44/434 |
| 5,211,721 | 5/1993 | Sung et al. | 44/389 |

FOREIGN PATENT DOCUMENTS 9007564 12/1990 WIPO .

*Primary Examiner*—Jerry D. Johnson

*Attorney, Agent, or Firm*—C. J. Caroli

[57] ABSTRACT

A fuel additive composition comprising:

(a) a poly(oxyalkylene) hydroxyaromatic ester having the formula:

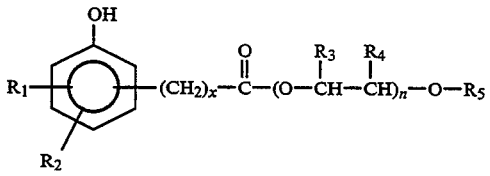

or a fuel-soluble salt thereof; where $R_1$ and $R_2$ are each independently hydrogen, hydroxy, lower alkyl having 1 to 6 carbon atoms, or lower alkoxy having 1 to 6 carbon atoms; $R_3$ and $R_4$ are each independently hydrogen or lower alkyl having 1 to 6 carbon atoms; $R_5$ is hydrogen, alkyl having 1 to 30 carbon atoms, phenyl, aralkyl or alkaryl having 7 to 36 carbon atoms, or an acyl group having the formula:

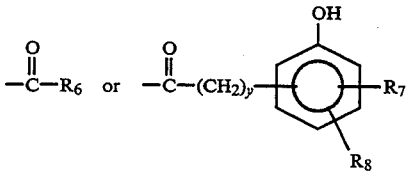

where $R_6$ is alkyl having 1 to 30 carbon atoms, phenyl, or aralkyl or alkaryl having 7 to 36 carbon atoms; $R_7$ and $R_8$ are each independently hydrogen, hydroxy, lower alkyl having 1 to 6 carbon atoms, or lower alkoxy having 1 to 6 carbon atoms; n is an integer from 5 to 100; and x and y are each independently an integer from 0 to 10; and (b) a poly(oxyalkylene) amine having at least one basic nitrogen atom and a sufficient number of oxyalkylene units to render the poly(oxyalkylene) amine soluble in hydrocarbons boiling in the gasoline or diesel range.

44 Claims, No Drawings

FUEL ADDITIVE COMPOSITIONS CONTAINING POLY(OXYALKYLENE) HYDROXYAROMATIC ESTERS AND POLY(OXYALKYLENE) AMINES

BACKGROUND OF THE INVENTION

1. Field of the Invention

This invention relates to a fuel additive composition. More particularly, this invention relates to a fuel additive composition containing a poly(oxyalkylene) hydroxyaromatic ester and a poly(oxyalkylene) amine.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, aliphatic hydrocarbon-substituted phenols are known to reduce engine deposits when used in fuel compositions. U.S. Pat. No. 3,849,085, issued Nov. 19, 1974 to Kreuz et al., discloses a motor fuel composition comprising a mixture of hydrocarbons in the gasoline boiling range containing about 0.01 to 0.25 volume percent of a high molecular weight aliphatic hydrocarbon-substituted phenol in which the aliphatic hydrocarbon radical has an average molecular weight in the range of about 500 to 3,500. This patent teaches that gasoline compositions containing minor amount of an aliphatic hydrocarbon-substituted phenol not only prevent or inhibit the formation of intake valve and port deposits in a gasoline engine, but also enhance the performance of the fuel composition in engines designed to operate at higher operating temperatures with a minimum of decomposition and deposit formation in the manifold of the engine.

Similarly, U.S. Pat. No. 4,134,846, issued Jan. 16, 1979 to Machleder et al., discloses a fuel additive composition comprising a mixture of (1) the reaction product of an aliphatic hydrocarbon-substituted phenol, epichlorohydrin and a primary or secondary mono- or polyamine, and (2) a polyalkylene phenol. This patent teaches that such compositions show excellent carburetor, induction system and combustion chamber detergency and, in addition, provide effective rust inhibition when used in hydrocarbon fuels at low concentrations.

Poly(oxyalkylene) amines are also well known in the art as fuel additives for the prevention and control of engine deposits. For example, U.S. Pat. No. 4,191,537, issued Mar. 4, 1980 to R. A. Lewis et al., discloses a fuel composition comprising a major portion of hydrocarbons boiling in the gasoline range and from 30 to 2000 ppm of a hydrocarbyl poly(oxyalkylene) aminocarbamate having a molecular weight from about 600 to 10,000, and at least one basic nitrogen atom. The hydrocarbyl poly(oxyalkylene) moiety is composed of oxyalkylene units selected from 2 to 5 carbon oxyalkylene units. These fuel compositions are taught to maintain the cleanliness of intake systems without contributing to combustion chamber deposits.

Similar poly(oxyalkylene) amine fuel additives and fuel compositions containing such additives are described in U.S. Pat. Nos. 4,160,648; 4,197,409; 4,233,168; 4,236,020; 4,243,798; 4,247,301; 4,261,704; 4,270,930; 4,274,837; 4,281,199; 4,288,612; 4,329,240; 4,332,595; 4,604,103; 4,778,481; 4,881,945; 5,055,607; 5,094,667; and in PCT International Pat. Application Publication No. WO 90/07564, published Jul. 12, 1990.

It has now been discovered that the combination of a poly(oxyalkylene) amine and a novel poly(oxyalkylene) hydroxyaromatic ester affords a unique fuel additive composition that provides unexpectedly superior deposit control performance and fewer combustion chamber deposits than either component individually.

SUMMARY OF THE INVENTION

The present invention provides a novel fuel additive composition comprising:

(a) a poly(oxyalkylene) hydroxyaromatic ester having the formula:

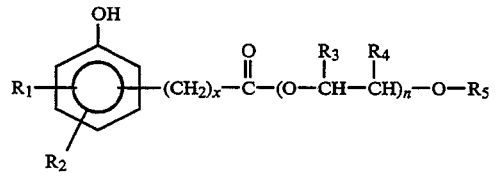

(I)

or a fuel-soluble salt thereof; wherein $R_1$ and $R_2$ are each independently hydrogen, hydroxy, lower alkyl having 1 to 6 carbon atoms, or lower alkoxy having 1 to 6 carbon atoms; $R_3$ and $R_4$ are each independently hydrogen or lower alkyl having 1 to 6 carbon atoms; $R_5$ is hydrogen, alkyl having 1 to 30 carbon atoms, phenyl, aralkyl or alkaryl having 7 to 36 carbon atoms, or an acyl group of the formula:

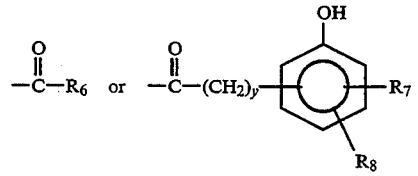

wherein $R_6$ is alkyl having 1 to 30 carbon atoms, phenyl, or aralkyl or alkaryl having 7 to 36 carbon atoms; $R_7$ and $R_8$ are each independently hydrogen, hydroxy, lower alkyl having 1 to 6 carbon atoms, or lower alkoxy having 1 to 6 carbon atoms; n is an integer from 5 to 100; and x and y are each independently an integer from 0 to 10; and (b) a poly(oxyalkylene) amine having at least one basic nitrogen atom and a sufficient number of oxyalkylene units to render the poly(oxyalkylene) amine soluble in hydrocarbons boiling in the gasoline or diesel fuel range.

The present invention further provides a fuel composition comprising a major amount of hydrocarbons boiling in the gasoline or diesel range and an effective deposit-controlling amount of the novel fuel additive composition of the present invention.

The present invention additionally provides a fuel concentrate comprising an inert stable oleophilic organic solvent boiling in the range of from about 150° F.

to 400° F. and from about 10 to 70 weight percent of the fuel additive composition of the present invention.

Among other factors, the present invention is based on the surprising discovery that the unique combination of a poly(oxyalkylene) hydroxyaromatic ether and a poly(oxyalkylene) amine provides unexpectedly superior deposit control performance and fewer combustion chamber deposits than either component individually.

DETAILED DESCRIPTION OF THE INVENTION

As used herein the following terms have the following meanings unless expressly stated to the contrary.

The term "alkyl" refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "lower alkoxy" refers to the group $-OR_a$ wherein $R_a$ is lower alkyl. Typical lower alkoxy groups include methoxy, ethoxy, and the like.

The term "alkaryl" refers to the group:

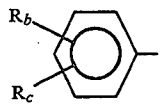

wherein $R_b$ and $R_c$ are each independently hydrogen or an alkyl group, with the proviso that both $R_b$ and $R_c$ are not hydrogen. Typical alkaryl groups include, for example, tolyl, xylyl, cumenyl, ethylphenyl, butylphenyl, dibutylphenyl, hexylphenyl, octylphenyl, dioctylphenyl, nonylphenyl, decylphenyl, didecylphenyl, dodecylphenyl, hexadecylphenyl, octadecylphenyl, icosylphenyl, tricontylphenyl and the like. The term "alkylphenyl" refers to an alkaryl group of the above formula in which $R_b$ is alkyl and $R_c$ is hydrogen.

The term "aralkyl" refers to the group:

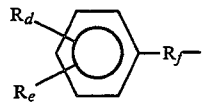

wherein $R_d$ and $R_e$ are each independently hydrogen or an alkyl group; and $R_f$ is an alkylene group. Typical alkaryl groups include, for example, benzyl, methylbenzyl, dimethylbenzyl, phenethyl, and the like.

The term "hydrocarbyl" refers to an organic radical composed primarily of carbon and hydrogen which may be aliphatic, alicyclic, aromatic or combinations thereof, e.g., aralkyl or alkaryl. Such hydrocarbyl groups are generally relatively free of aliphatic unsaturation, i.e., olefinic or acetylenic unsaturation.

The term "oxyalkylene unit" refers to an ether moiety having the general formula:

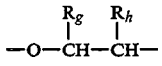

wherein $R_g$ and $R_h$ are each independently hydrogen or lower alkyl groups.

The term "poly(oxyalkylene)" refers to a polymer or oligomer having the general formula:

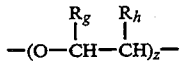

wherein $R_g$ and $R_h$ are as defined above, and z is an integer greater than 1. When referring herein to the number of poly(oxyalkylene) units in a particular poly(oxyalkylene) compound, it is to be understood that this number refers to the average number of poly(oxyalkylene) units in such compounds unless expressly stated to the contrary.

The Poly(oxyalkylene) Hydroxyaromatic Ester

The poly(oxyalkylene) hydroxyaromatic ester component of the present invention has the general formula:

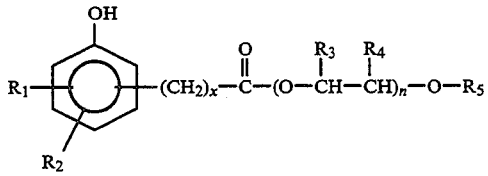

(I)

or a fuel-soluble salt thereof; wherein $R_1$, $R_2$, $R_3$, $R_4$, $R_5$, n and x are as defined hereinabove.

Preferably, $R_1$ is hydrogen, hydroxy, or lower alkyl having 1 to 4 carbon atoms. More preferably, $R_1$ is hydrogen or hydroxy. Most preferably, $R_1$ is hydrogen.

$R_2$ is preferably hydrogen.

Preferably, one of $R_3$ and $R_4$ is lower alkyl having 1 to 3 carbon atoms and the other is hydrogen. More preferably, one of $R_3$ and $R_4$ is methyl or ethyl and the other is hydrogen. Most preferably, one of $R_3$ and $R_4$ is ethyl and the other is hydrogen.

$R_5$ is preferably hydrogen, alkyl having 2 to 22 carbon atoms, or alkylphenyl having an alkyl group containing 2 to 24 carbon atoms. More preferably, $R_5$ is hydrogen, alkyl having 4 to 12 carbon atoms or alkylphenyl having an alkyl group containing 4 to 12 carbon atoms. Most preferably, $R_5$ is alkylphenyl having an alkyl group containing 4 to 12 carbon atoms.

$R_6$ is preferably alkyl having 4 to 12 carbon atoms.

Preferably, $R_7$ is hydrogen, hydroxy, or lower alkyl having 1 to 4 carbon atoms. More preferably, $R_7$ is hydrogen or hydroxy. Most preferably, $R_7$ is hydrogen.

$R_8$ is preferably hydrogen.

Preferably, n is an integer from 10 to 50. More preferably, n is an integer from 15 to 30. Preferably, x is an integer from 0 to 2. More preferably, x is 0. Preferably, y is an integer from 0 to 2. More preferably, y is 0.

A preferred group of poly(oxyalkylene) hydroxyaromatic esters for use in this invention are those of formula I wherein $R_1$ is hydrogen, hydroxy, or lower alkyl having 1 to 4 carbon atoms; $R_2$ is hydrogen; one of $R_3$ and $R_4$ is hydrogen and the other is methyl or ethyl; $R_5$ is hydrogen, alkyl having 2 to about 22 carbon atoms or alkylphenyl having an alkyl group containing 4 to about 24 carbon atoms; n is 15 to 30 and x is 0.

Another preferred group of poly(oxyalkylene) hydroxyaromatic esters for use in this invention are those of formula I wherein $R_1$ is hydrogen, hydroxy, or lower alkyl having 1 to 4 carbon atoms; $R_2$ is hydrogen; one of $R_3$ and $R_4$ is hydrogen and the other is methyl or ethyl;

$R_5$ is hydrogen, alkyl having 2 to about 22 carbon atoms or alkylphenyl having an alkyl group containing 4 to about 24 carbon atoms; n is 15 to 30 and x is 1 or 2.

A more preferred group of poly(oxyalkylene) hydroxyaromatic esters for use in this invention are those of formula I wherein $R_1$ is hydrogen or hydroxy; $R_2$ is hydrogen; one of $R_3$ is and $R_4$ is hydrogen and the other is methyl or ethyl; $R_5$ is hydrogen, alkyl having 4 to 12 carbon atoms or alkylphenyl having an alkyl group containing 4 to 12 carbon atoms: n is 15 to 30; and x is 0.

A particularly preferred group of poly(oxyalkylene) hydroxyaromatic esters for use in this invention are those having the formula:

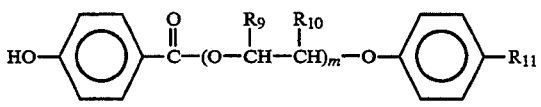

(II)

wherein one of $R_9$ and $R_{10}$ is methyl or ethyl and the other is hydrogen; $R_{11}$ is an alkyl group having 4 to 12 carbon atoms; and m is an integer from 15 to 30.

It is especially preferred that the aromatic hydroxyl group or groups present in the poly(oxyalkylene) hydroxyaromatic esters employed in this invention be situated in a meta or para position relative to the poly(oxyalkylene) ester moiety. When the aromatic moiety contains one hydroxyl group, it is particularly preferred that this hydroxyl group be in a para position relative to the poly(oxyalkylene) ester moiety.

The poly(oxyalkylene) hydroxyaromatic ester component of the present fuel additive composition will generally have a sufficient molecular weight so as to be non-volatile at normal engine intake valve operating temperatures (about 200°–250° C.). Typically, the molecular weight of the poly(oxyalkylene) hydroxyaromatic ester component will range from about 600 to about 10,000, preferably from 1,000 to 3,000.

Generally, the poly(oxyalkylene) hydroxyaromatic esters employed in this invention will contain an average of about 5 to about 100 oxyalkylene units; preferably, 10 to 50 oxyalkylene units; more preferably, 15 to 30 oxyalkylene units.

Fuel-soluble salts of the poly(oxyalkylene) hydroxyaromatic esters are also contemplated to be useful in the fuel additive composition of the present invention. Such salts include alkali metal, alkaline earth metal, ammonium, substituted ammonium and sulfonium salts. Preferred metal salts are the alkali metal salts, particularly the sodium and potassium salts, and the substituted ammonium salts, particularly tetraalkyl-substituted ammonium salts, such as the tetrabutylammonium salts.

General Synthetic Procedures

The poly(oxyalkylene) hydroxyaromatic ester component of the present fuel additive composition may be prepared by the following general methods and procedures. It should be appreciated that where typical or preferred process conditions (e. g. reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

The poly(oxyalkylene) hydroxyaromatic esters employed in the present fuel additive composition that have the formula:

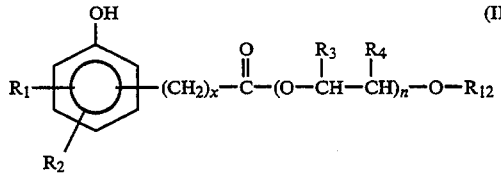

(III)

wherein $R_1$–$R_4$, n and x are as defined above and $R_{12}$ is an alkyl, phenyl, aralkyl or alkaryl group, may be prepared by esterifying a hydroxyaromatic carboxylic acid having the formula:

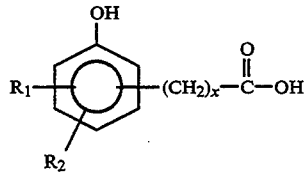

(IV)

wherein $R_1$, $R_2$, and x are as defined above, with a poly(oxyalkylene) alcohol having the formula:

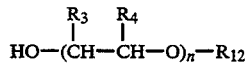

(V)

wherein $R_3$, $R_4$, $R_{12}$ and n are as defined above, using conventional esterification reaction conditions.

The hydroxyaromatic carboxylic acids of formula IV are either known compounds or can be prepared from known compounds by conventional procedures. Suitable hydroxyaromatic carboxylic acids for use as starting materials in this invention are 2-hydroxybenzoic acid, 3-hydroxybenzoic acid, acid, 4-hydroxybenzoic acid, 3,4-dihydroxybenzoic acid, 3,4,5-trihydroxybenzoic acid, 3-hydroxy-4-methoxybenzoic acid, 4-hydroxy-3-methoxybenzoic acid, 3-t-butyl-4-hydroxybenzoic acid, 3,5-di-t-butyl-4-hydroxybenzoic acid, 4-hydroxyacetic acid, 3-(4-hydroxyphenyl)propionic acid and the like.

The poly(oxyalkylene) alcohols of formula V may also be prepared by conventional procedures known in the art. Such procedures are taught, for example, in U.S. Pat. Nos. 2,782,240 and 2,841,479, which are incorporated herein by reference.

Preferably, the poly(oxyalkylene) alcohols of formula V are prepared by contacting an alkoxide or phenoxide metal salt having the formula:

$$R_{12}OM \qquad \text{(VI)}$$

wherein $R_{12}$ is as defined above and M is a metal cation, such as lithium, sodium, or potassium, with about 5 to about 100 molar equivalents of an alkylene oxide (an epoxide) having the formula:

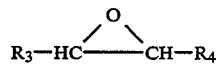

(VII)

wherein $R_3$ and $R_4$ are as defined above.

Generally, metal salt VI is prepared by contacting the corresponding hydroxy compound $R_{12}OH$ with a strong base, such as sodium hydride, potassium hydride, sodium amide and the like, in an inert solvent, such as toluene, xylene and the like, under substantially anhydrous conditions at a temperature in the range from about −10° C. to about 120° C. for about 0.25 to about 3 hours.

Metal salt VI is generally not isolated, but is reacted in situ with the alkylene oxide VII to provide, after neutralization, the poly(oxyalkylene) alcohol V. This polymerization reaction is typically conducted in a substantially anhydrous inert solvent at a temperature of about 30° C. to about 150° C. for about 2 to about 120 hours. Suitable solvents for this reaction, include toluene, xylene and the like. The reaction will generally be conducted at a pressure sufficient to contain the reactants and the solvent, preferably at atmospheric or ambient pressure.

The amount of alkylene oxide employed in this reaction will depend on the number of oxyalkylene units desired in the product. Typically, the molar ratio of alkylene oxide VII to metal salt VI will range from about 5:1 to about 100:1; preferably, from 10:1 to 50:1, more preferably from 15:1 to 30:1.

Suitable alkylene oxides for use in the polymerization reaction include, for example, ethylene oxide; propylene oxide; butylene oxides, such as 1,2-butylene oxide (1,2-epoxybutane) and 2,3-butylene oxide (2,3-epoxybutane); pentylene oxides; hexylene oxides; octylene oxides and the like. Preferred alkylene oxides are propylene oxide and 1,2-butylene oxide.

In the polymerization reaction, a single type of alkylene oxide may be employed, e.g. propylene oxide, in which case the product is a homopolymer, e.g. a poly(oxypropylene).

However, copolymers are equally satisfactory and random copolymers are readily prepared by contacting the metal salt VI with a mixture of alkylene oxides, such as a mixture of propylene oxide and 1,2-butylene oxide, under polymerization conditions. Copolymers containing blocks of oxyalkylene units are also suitable for use in the present invention. Block copolymers may be prepared by contacting the metal salt VI with first one alkylene oxide, then others in any order, or repetitively, under polymerization conditions.

The poly(oxyalkylene) alcohol V may also be prepared by living or immortal polymerization as described by S. Inoue and T. Aida in *Encyclopedia of Polymer Science and Engineering*, Second Edition, Supplemental Volume, J. Wiley and Sons, New York, pages 412–420 (1989). These procedures are especially useful for preparing poly(oxyalkylene) alcohols of formula V in which $R_3$ and $R_4$ are both alkyl groups.

As noted above, the alkoxide or phenoxide metal salt VI is generally derived from the corresponding hydroxy compound, $R_{12}OH$. Preferred hydroxy compounds for use in this invention include straight- or branched-chain aliphatic alcohols having 1 to about 30 carbon atoms and phenols having the formula:

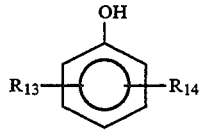

(VIII)

wherein R—and $R_{14}$ are each independently hydrogen or an alkyl group having 1 to about 30 carbon atoms.

Preferably, the straight- or branched-chain aliphatic alcohols employed in this invention will contain 2 to about 22 carbon atoms, more preferably 4 to 12 carbon atoms. Representative examples of straight- or branched-chain aliphatic alcohols suitable for use in this invention include, but are not limited to, n-butanol; isobutanol; sec-butanol; t-butanol; n-pentanol; n-hexanol; n-heptanol; n-octanol; isooctanol; n-nonanol; n-decanol; n-dodecanol; n-hexadecanol (cetyl alcohol); n-octadecanol (stearyl alcohol); alcohols derived from linear $C_{10}$ to $C_{30}$ alpha olefins and mixtures thereof; and alcohols derived from polymers of $C_2$ to $C_6$ olefins, such as alcohols derived from polypropylene and polybutene, including polypropylene alcohols having 9 to about 30 carbon atoms. Particularly preferred aliphatic alcohols are butanols.

The alkylphenols of formula VIII may be monoalkyl-substituted phenols or dialkyl-substituted phenols. Monoalkyl-substituted phenols are preferred, especially monoalkylphenols having an alkyl substituent in the para position.

Preferably, the alkyl group of the alkylphenols will contain 4 to about 24 carbon atoms, more preferably 4 to 12 carbon atoms. Representative examples of phenols suitable include, phenol, methylphenol, dimethylphenol, ethylphenol, butylphenol, octylphenol, decylphenol, dodecylphenol, tetradecylphenol, hexadecylphenol, octadecylphenol, eicosylphenol, tetracosylphenol, hexacosylphenol, triacontylphenol and the like. Also, mixtures of alkylphenols may be employed, such as a mixture of $C_{14}$–$C_{18}$ alkylphenols, a mixture of $C_{18}$–$C_{24}$ alkylphenols, a mixture of $C_{20}$–$C_{24}$ alkylphenols, or a mixture of $C_{16}$–$C_{26}$ alkylphenols.

Particularly preferred alkylphenols are those derived from alkylation of phenol with polymers or oligomers of $C_3$ to $C_6$ olefins, such as polypropylene or polybutene. These polymers preferably contain 10 to 30 carbon atoms. An especially preferred alkylphenol is prepared by alkylating phenol with a propylene polymer having an average of 4 units. This polymer has the common name of propylene tetramer and is commercially available.

As indicated above, the poly(oxyalkylene) hydroxyaromatic esters of formula III may be prepared by esterifying a hydroxyaromatic carboxylic acid of formula IV with a poly(oxyalkylene) alcohol of formula V under conventional esterification reaction conditions.

Typically, this reaction will be conducted by contacting a poly(oxyalkylene) alcohol of formula V with about 0.25 to about 1.5 molar equivalents of a hydroxyaromatic carboxylic acid of formula IV in the presence of acidic catalyst at a temperature in the range of 70° C. to about 160° C. for about 0.5 to about 48 hours. Suitable acid catalysts for this reaction include p-toluenesulfonic acid, methanesulfonic acid and the like. The reaction may be conducted in the presence or absence of an inert solvent, such as benzene, toluene and the like. The water generated by this reaction is preferably removed during the course of the reaction by, for example, azeotropic distillation with an inert solvent, such as toluene.

The poly(oxyalkylene) hydroxyaromatic esters of formula III may also be synthesized by reacting a poly(oxyalkylene) alcohol of formula V with an acyl halide having the formula:

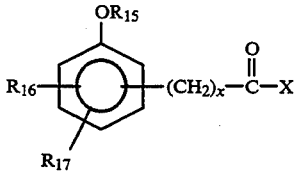

(IX)

wherein X is a halide, such as chloride or bromide, and $R_{15}$ is a suitable hydroxyl protecting group, such as benzyl, tert-butyldimethylsilyl, methoxymethyl, and the like; $R_{16}$ and $R_{17}$ are each independently hydrogen, lower alkyl, lower alkoxy, or the group $—OR_{18}$, wherein $R_{18}$ is a suitable hydroxyl protecting group.

Acyl halides of formula IX may be prepared from hydroxyaromatic carboxylic acids of formula IV by first protecting the aromatic hydroxyl groups of IV to form a carboxylic acid having the formula:

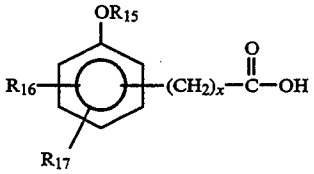

(X)

wherein $R_{15}$–$R_{17}$ and x are as defined above, and then converting the carboxylic acid moiety of X into an acyl halide using conventional procedures.

Protection of the aromatic hydroxyl groups of IV may be accomplished using well known procedures. The choice of a suitable protecting group for a particular hydroxyaromatic carboxylic acid will be apparent to those skilled in the art. Various protecting groups, and their introduction and removal, are described, for example, in T. W. Greene and P. G. M. Wuts, *Protective Groups in Organic Synthesis*, Second Edition, Wiley, New York, 1991, and references cited therein. Alternatively, the protected derivatives X can be prepared from known starting materials other than the hydroxyaromatic compounds of formula IV by conventional procedures.

The carboxylic acid moiety of X may be converted into an acyl halide by contacting X with an inorganic acid halide, such as thionyl chloride, phosphorous trichloride, phosphorous tribromide, or phosphorous pentachloride; or alternatively, with oxalyl chloride. Generally, this reaction will be conducted using about 1 to 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction.

In certain cases where the hydroxyaromatic carboxylic acids of formula IV having bulky alkyl groups adjacent to the hydroxyl group, such as 3,5-di-t-butyl-4-hydroxybenzoic acid, it will generally not be necessary to protect the hydroxyl group prior to formation of the acyl halide, since such hydroxyl groups are sufficiently sterically hindered so as to be substantially non-reactive with the acyl halide moiety.

Reaction of acyl halide IX with poly(oxyalkylene) alcohol V provides an intermediate poly(oxyalkylene) ester having the formula:

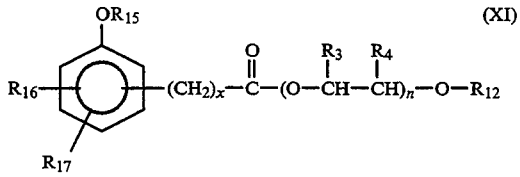

(XI)

wherein $R_3$, $R_4$, $R_{12}$, $R_{15}$–$R_{17}$, n and x are as defined above.

Typically, this reaction is conducted by contacting V with about 0.9 to about 1.5 molar equivalents of IX in an inert solvent, such as toluene, dichloromethane, diethyl ether, and the like, at a temperature in the range of about 25° C. to about 150° C. The reaction is generally complete in about 0 5 to about 48 hours. Preferably, the reaction is conducted in the presence of a sufficient amount of an amine capable of neutralizing the acid generated during the reaction, such as triethylamine, di(isopropyl)ethylamine, pyridine or 4-dimethylaminopyridine.

Deprotection of the aromatic hydroxyl group(s) of XI then provides a poly(oxyalkylene) hydroxyaromatic ester of formula III. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from about 0° C. to about 40° C. for about 1 to about 24 hours.

The poly(oxyalkylene) hydroxyaromatic esters employed in the present fuel additive composition that have the formula:

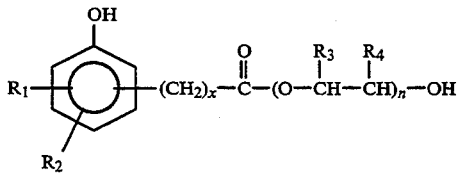

(XII)

wherein $R_1$–$R_4$, n and x are as defined above, can be prepared from compounds of formula III or XI, wherein $R_{12}$ is a benzyl group, by removing the benzyl group using conventional hydrogenolysis procedures. Compounds of formula III or XI where $R_{12}$ represents a benzyl group may be prepared by employing a metal salt VI derived from benzyl alcohol in the above described synthetic procedures.

Similarly, the poly(oxyalkylene) hydroxyaromatic esters employed in the present invention that have the formula:

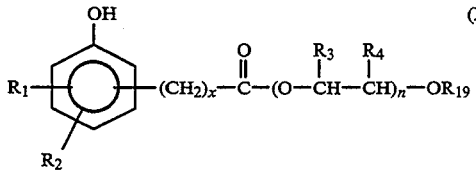

(XIII)

wherein $R_1$–$R_4$, n and x are as defined above and $R_{19}$ is an acyl group having the formula:

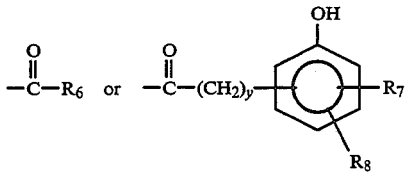

wherein $R_6$–$R_8$ and y are as defined above, can be synthesized in several steps from a compound of formula XI, wherein $R_{12}$ represents a benzyl group and $R_{15}$ (and optionally $R_{18}$) represents a hydroxyl protecting group that is stable to hydrogenolysis conditions, such as a tert-butyldimethylsilyl group. The synthesis of XIII from such compounds may be effected by first removing the benzyl group using conventional hydrogenolysis conditions and then acylating the resulting hydroxyl group with a suitable acylating agent. Removal of the protecting group(s) from the aromatic hydroxyl group(s) using conventional procedures then provides a poly(oxyalkylene) hydroxyaromatic ester of formula XIII.

Suitable acylating agents for use in this reaction include acyl halides, such as acyl chlorides and bromides; and carboxylic acid anhydrides. Preferred acylating agents are those having the formula: $R_6C(O)$—X, wherein $R_6$ is alkyl having 1 to 30 carbon atom, phenyl, or aralkyl or alkaryl having 7 to 36 carbon atoms, and X is chloro or bromo; and those having the formula:

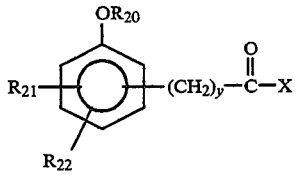

(XIV)

wherein X is a halide, such as chloride or bromide, $R_{20}$ is a suitable hydroxyl protecting group, $R_{21}$ and $R_{22}$ are each independently hydrogen, lower alkyl, lower alkoxy, or the group —$OR_{23}$, wherein $R_{23}$ is a suitable hydroxyl protecting group, and y is an integer from 0 to 10.

A particularly preferred group of acylating agents are those having the formula: $R_{24}C(O)$—X, wherein $R_{24}$ is alkyl having 4 to 12 carbon atoms. Representative examples of such acylating agents include acetyl chloride, propionyl chloride, butanoyl chloride, pivaloyl chloride, octanoyl chloride, decanoyl chloride and the like.

Another particularly preferred group of acylating agents are those of formula XIV, wherein $R_{20}$ is benzyl; $R_{21}$ is hydrogen, alkyl having 1 to 4 carbon atoms, or —$OR_{25}$, wherein $R_{25}$ is a suitable hydroxyl protecting group, preferably benzyl; $R_{22}$ is hydrogen; and y is 0, 1 or 2. Representative examples of such acylating agents include 4-benzyloxybenzoyl chloride, 3-benzyloxybenzoyl chloride, 4-benzyloxy-3-methylbenzoyl chloride, 4-benzyloxyphenylacetyl chloride, 3-(4-benzyloxyphenyl)propionyl chloride and the like.

Generally, this acylation reaction will be conducted using about 0.95 to about 1.2 molar equivalents of the acylating agent. The reaction is typically conducted in an inert solvent, such as toluene, dichloromethane, diethyl ether and the like, at a temperature in the range of about 25° C. to about 150° C. for about 0.5 to about 48 hours. When an acyl halide is employed as the acylating agent, the reaction is preferably conducted in the presence of a sufficient amount of an amine capable of neutralizing the acid generated during the reaction, such as triethylamine, di(isopropyl)ethylamine, pyridine or 4-dimethylaminopyridine.

A particularly preferred group of poly(oxyalkylene) hydroxyaromatic esters of formula XIII are those having the same hydroxyaromatic ester group at each end the poly(oxyalkylene) moiety, i.e. compounds of formula XIII wherein $R_{19}$ is an acyl group having the formula:

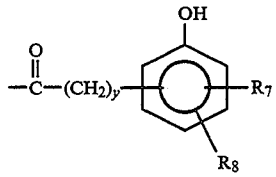

wherein $R_7$ is the same group as $R_1$, $R_8$ is the same group as $R_2$, and x and y are the same integer.

These compounds may be prepared from a poly(oxyalkylene) diol having the formula:

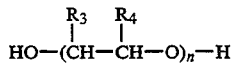

(XV)

wherein $R_3$, $R_4$, and n are as defined above, by esterifying each of the hydroxyl groups present in XV with a hydroxyaromatic carboxylic acid of formula IV or an acyl halide of formula IX using the above described synthetic procedures. The poly(oxyalkylene) diols of formula XV are commercially available or may be prepared by conventional procedures, for example, by using sodium or potassium hydroxide in place of the alkoxide or phenoxide metal salt VI in the above described alkylene oxide polymerization reaction.

The Poly(oxyalkylene) Amine

The poly(oxyalkylene) amine component of the present fuel additive composition is a poly(oxyalkylene) amine having at least one basic nitrogen atom and a sufficient number of oxyalkylene units to render the poly(oxyalkylene) amine soluble in hydrocarbons boiling in the gasoline or diesel range.

Preferably, such poly(oxyalkylene) amines will also be of sufficient molecular weight so as to be nonvolatile at normal engine intake valve operating temperatures, which are generally in the range of about 200° C. to 250° C.

Generally, the poly(oxyalkylene) amines suitable for use in the present invention will contain at least about 5 oxyalkylene units, preferably about 5 to 100, more preferably about 8 to 100, and even more preferably about 10 to 100. Especially preferred poly(oxyalkylene) amines will contain about 10 to 25 oxyalkylene units.

The molecular weight of the presently employed poly(oxyalkylene) amines will generally range from about 500 to about 10,000, preferably from about 500 to about 5,000.

Suitable poly(oxyalkylene) amine compounds for use in the present invention include hydrocarbyl poly(oxyalkylene) polyamines as disclosed, for example, in U.S. Pat. No. 4,247,301, issued Jan. 27, 1981 to Honnen, the disclosure of which is incorporated herein by reference. These compounds are hydrocarbyl poly(oxyalkylene) polyamines wherein the poly(oxyalkylene) moiety comprises at least one hydrocarbyl-terminated poly(oxyalkylene) chain of 2 to 5 carbon atom oxyalkylene units, and wherein the poly(oxyalkylene) chain is bonded through a terminal carbon atom to a nitrogen atom of a polyamine having from 2 to about 12 amine nitrogen atoms and from 2 to about 40 carbon atoms with a carbon-to-nitrogen ratio between about 1:1 and 10:1. The hydrocarbyl group on these hydrocarbyl poly(oxyalkylene) polyamines will contain from about 1 to 30 carbon atoms. These compounds generally have molecular weights in the range of about 500 to 10,000, preferably from about 500 to 5,000 and more preferably from about 800 to 5,000.

The above-described hydrocarbyl poly(oxyalkylene) polyamines are prepared by conventional procedures known in the art, as taught, for example, in U.S. Pat. No. 4,247,301.

Other poly(oxyalkylene) amines suitable for use in the present invention are the poly(oxyalkylene) polyamines wherein the poly(oxyalkylene) moiety is connected to the polyamine moiety through an oxyalkylene hydroxy-type linkage derived from an epihalohydrin, such as epichlorohydrin or epibromohydrin. This type of poly(oxyalkylene) amine having an epihalohydrin-derived linkage is described, for example, in U.S. Pat. No. 4,261,704, issued Apr. 14, 1981 to Langdon, the disclosure of which is incorporated herein by reference.

Useful polyamines for preparing the epihalohydrin-derived poly(oxyalkylene) polyamines include, for example, alkylene polyamines, polyalkylene polyamines, cyclic amines, such as piperazines, and amino-substituted amines. The poly(oxyalkylene) polyamines having an epihalohydrin-derived linkage between the poly(oxyalkylene) and polyamine moieties are prepared using known procedures as taught, for example, in U.S. Pat. No. 4,261,704.

Another type of poly(oxyalkylene) amine useful in the present invention is a highly branched alkyl poly(oxyalkylene) monoamine as described, for example in U.S. Pat. No. 5,094,667, issued Mar. 10, 1992 to Schilowitz et al., the disclosure of which is incorporated herein by reference. These highly branched alkyl poly(oxyalkylene) monoamines have the general formula:

$$R_{26}—O—(C_4H_8O)_pCH_2CH_2CH_2NH_2 \quad \text{(XVI)}$$

wherein $R_{26}$ is a highly branched alkyl group containing from 12 to 40 carbon atoms, preferably an alkyl group having 20 carbon atoms which is derived from a Guerbet condensation reaction, and p is a number up to 30, preferably 4 to 8. The preferred alkyl group is derived from a Guerbet alcohol containing 20 carbon atoms having the formula:

$$\begin{array}{l} R_{27}—CHCH_2OH \\ \quad\quad\;\; | \\ \quad\quad CH_2CH_2R_{27} \end{array} \quad \text{(XVII)}$$

wherein $R_{27}$ is a hydrocarbyl chain.

The above highly branched alkyl poly(oxyalkylene) monoamines are prepared by using known methods as disclosed, for example, in U.S. Pat. No. 5,094,667.

A particularly preferred class of poly(oxyalkylene) amine for use in the fuel additive composition of the present invention are the hydrocarbyl-substituted poly(oxyalkylene) aminocarbamates disclosed, for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene) aminocarbamates contain at least one basic nitrogen atom and have an average molecular weight of about 500 to 10,000, preferably about 500 to 5,000, and more preferably about 1,000 to 3,000. As described more fully hereinbelow, these hydrocarbyl poly(oxyalkylene) aminocarbamates contain a (a) poly(oxyalkylene) moiety, (b) an amine moiety and (c) a carbamate connecting group.

A. The Poly (oxyalkylene) Moiety

The hydrocarbyl-terminated poly(oxyalkylene) polymers which are utilized in preparing the hydrocarbyl poly(oxyalkylene) aminocarbamates employed in the present invention are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. These hydrocarbyl poly(oxyalkylene) alcohols may be produced under conditions essentially the same as those described above for the preparation of V, i.e. by the addition of lower alkylene oxides, such as ethylene oxide, propylene oxide, butylene oxide, etc. to a hydroxy compound, $R_{28}OH$, under polymerization conditions, wherein $R_{28}$ is the hydrocarbyl group which caps the poly(oxyalkylene) chain.

In the hydrocarbyl poly(oxyalkylene) aminocarbamates employed in the present invention, the group $R_{28}$ will generally contain from 1 to about 30 carbon atoms, preferably from 2 to about 20 carbon atoms and is preferably aliphatic or aromatic, i.e., an alkyl or alkyl phenyl wherein the alkyl is a straight or branched-chain of from 1 to about 24 carbon atoms. More preferably, $R_{28}$ is alkylphenyl wherein the alkyl group is a branched-chain of 12 carbon atoms, derived from propylene tetramer, and commonly referred to as tetrapropenyl.

The oxyalkylene units in the poly(oxyalkylene) moiety preferably contain from 2 to about 5 carbon atoms but one or more units of a larger carbon number may also be present. Generally, each poly(oxyalkylene) polymer contains at least about 5 oxyalkylene units, preferably about 5 to about 100 oxyalkylene units, more preferably about 8 to about 100 units, even more preferably about 10 to 100 units, and most preferably 10 to about 25 such units. The poly(oxyalkylene) moiety of the hydrocarbyl poly(oxyalkylene) aminocarbamates employed in the present invention is more fully described and exemplified in U.S. Pat. No. 4,191,537, issued Mar. 4, 1980 to Lewis, the disclosure of which is incorporated herein by reference.

Although the hydrocarbyl group on the hydrocarbyl poly(oxyalkylene) moiety will preferably contain from 1 to about 30 carbon atoms, longer hydrocarbyl groups, particularly longer chain alkyl phenyl groups, may also be employed. For example, alkylphenyl poly(oxyalkylene) aminocarbamates wherein the alkyl group contains at least 40 carbon atoms, as described in U.S. Pat. No. 4,881,945, issued Nov. 21, 1989 to Buckley, are also contemplated for use in the present invention. The alkyl phenyl group on the aminocarbamates of U.S. Pat. No. 4,881,945 will preferably contain an alkyl group of 50 to 200 carbon atoms, and more preferably, an alkyl group of 60 to 100 carbon atoms. The disclosure of U.S. Pat. No. 4,881,945 is incorporated herein by reference.

Also contemplated for use in the present invention are alkylphenyl poly(oxypropylene) aminocarbamates wherein the alkyl group is a substantially straight-chain alkyl group of about 25 to 50 carbon atoms derived from an alpha olefin oligomer of $C_8$ to $C_{20}$ alpha olefins, as described in PCT International Pat. Application Publication No. WO 90/07564, published Jul. 12, 1990, the disclosure of which is incorporated herein by reference.

B. The Amine Moiety

The amine moiety of the hydrocarbyl poly(oxyalkylene) aminocarbamate is preferably derived from a polyamine having from 2 to about 12 amine nitrogen atoms and from 2 to about 40 carbon atoms.

The polyamine is preferably reacted with a hydrocarbyl poly(oxyalkylene) chloroformate to produce the hydrocarbyl poly(oxyalkylene) aminocarbamate fuel additive finding use within the scope of the present invention. The chloroformate is itself derived from hydrocarbyl poly(oxyalkylene) alcohol by reaction with phosgene.

The polyamine provides the hydrocarbyl poly(oxyalkylene) aminocarbamate with, on the average, at least about one basic nitrogen atom per carbamate molecule, i.e., a nitrogen atom titratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The amine moiety of the hydrocarbyl poly(oxyalkylene) aminocarbamates employed in the present invention has been described and exemplified more fully in U.S. Pat. No. 4,191,537.

A more preferred polyamine for use in preparing the hydrocarbyl poly(oxyalkylene) aminocarbamates finding use within the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylenetriamine, triethylenetetramine, di(trimethylene)triamine, dipropylenetriamine, tetraethylenepentamine, etc.

Among the polyalkylene polyamines, polyethylene polyamine and polypropylene polyamine containing 2 to about 12 amine nitrogen atoms and 2 to about 24 carbon atoms are especially preferred and in particular, the lower polyalkylene polyamines, e.g., ethylenediamine, diethylenetriamine, propylenediamine, dipropylenetriamine, etc., are most preferred.

C. The Aminocarbamate Connecting Group

The hydrocarbyl poly(oxyalkylene) aminocarbamate employed as the poly(oxyalkylene) amine component of the fuel additive composition of the present invention is obtained by linking the polyamine and the hydrocarbyl poly(oxyalkylene) alcohol together through a carbamate linkage, i.e.,

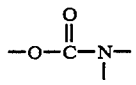

wherein the oxygen may be regarded as the terminal hydroxyl oxygen of the poly(oxyalkylene) alcohol, the nitrogen is derived from the polyamine and the carbonyl group —C(O)—, is preferably provided by a coupling agent, such as phosgene.

In a preferred method of preparation, the hydrocarbyl poly(oxyalkylene) alcohol is reacted with phosgene to produce a chloroformate and the chloroformate is reacted with the polyamine. Since there may be more than one nitrogen atom of the polyamine which is capable of reacting with the chloroformate, the carbamate product may contain more than one hydrocarbyl poly(oxyalkylene) moiety. It is preferred that the hydrocarbyl poly(oxyalkylene) aminocarbamate product contains on the average, about one poly(oxyalkylene) moiety per molecule (i.e., is a monocarbamate), although it is understood that this reaction route may lead to mixtures containing appreciable amounts of di- or higher poly(oxyalkylene) chain substitution on a polyamine containing several reactive nitrogen atoms.

A particularly preferred aminocarbamate is alkylphenyl poly(oxybutylene) aminocarbamate, wherein the amine moiety is derived from ethylene diamine or diethylene triamine. Synthetic methods to avoid higher degrees of substitution, methods of preparation, and other characteristics of the aminocarbamates used in the present invention are more fully described and exemplified in U.S. Pat. No. 4,191,537.

Fuel Compositions

The fuel additive composition of the present invention will generally be employed in hydrocarbon fuels to prevent and control engine deposits, particularly intake valve deposits. The proper concentration of the additive composition necessary to achieve the desired level of deposit control varies depending upon the type of fuel employed, the type of engine, and the presence of other fuel additives.

Generally, the present fuel additive composition will be employed in hydrocarbon fuel in a concentration ranging from about 75 to about 5,000 parts per million (ppm) by weight, preferably from 200 to 2,500 ppm.

In terms of individual components, hydrocarbon fuel containing the fuel additive composition of this invention will generally contain about 50 to 2,500 ppm of the poly(oxyalkylene) hydroxyaromatic ester component and about 25 to 1,000 ppm of the poly(oxyalkylene) amine component. The ratio of the poly(oxyalkylene) hydroxyaromatic ester to poly(oxyalkylene) amine will generally range from about 0.5:1 to about 10:1, and will preferably be about 1:1 or greater.

The fuel additive composition of the present invention may be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive composition will generally range from about 10 to about 70 weight percent, preferably 10 to 50 weight percent, more preferably from 20 to 40 weight percent.

In gasoline fuels, other fuel additives may be employed with the additives of the present invention, including, for example, oxygenates, such as t-butyl methyl ether, antiknock agents, such as methylcyclopentadienyl manganese tricarbonyl, and other dispersants/detergents, such as hydrocarbyl amines or succinimides. Additionally, antioxidants, metal deactivators and demulsifiers may be present.

In diesel fuels, other well-known additives can be employed, such as pour point depressants, flow improvers, cetane improvers, and the like.

A fuel-soluble, nonvolatile carrier fluid or oil may also be used with the fuel additive composition of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, and synthetic poly(oxyalkylene)-derived oils, such as those described, for example, in U.S. Pat. No. 4,191,537 to Lewis.

These carrier fluids are believed to act as a carrier for the fuel additive composition of the present invention and to assist in removing and retarding deposits. The carrier fluid may also exhibit synergistic deposit control properties when used in combination with the fuel additive composition of this invention.

The carrier fluids are typically employed in amounts ranging from about 100 to about 5000 ppm by weight of the hydrocarbon fuel, preferably from 400 to 3000 ppm of the fuel. Preferably, the ratio of carrier fluid to deposit control additive will range from about 0.5:1 to about 10:1, more preferably from 1:1 to 4:1, most preferably about 2:1.

When employed in a fuel concentrate, carrier fluids will generally be present in amounts ranging from about 20 to about 60 weight percent, preferably from 30 to 50 weight percent.

EXAMPLES

The following examples are presented to illustrate specific embodiments of the present invention and synthetic preparations thereof; and should not be interpreted as limitations upon the scope of the invention.

Example 1

Preparation of 4-Benzyloxybenzoyl Chloride

To a flask equipped with a magnetic stirrer and drying tube was added 10.0 grams of 4-benzyloxybenzoic acid and 100 mL of anhydrous diethyl ether and then 19.1 mL of oxalyl chloride. The resulting mixture was stirred at room temperature for 16 hours and then the solvent was removed in vacuo to yield 10.8 grams of the desired acid chloride.

Example 2

Preparation of α-(4-Benzyloxybenzoyl)-ω-4-dodecylphenoxypoly(oxybutylene)

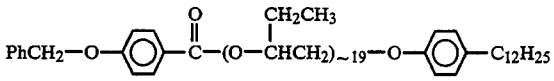

4-Benzyloxybenzoyl chloride (10.8 grams) from Example 1 was combined with 72.2 grams of α-hydroxy-ω-4-dodecylphenoxypoly(oxybutylene) having an average of 19 oxybutylene units (prepared essentially as described in Example 6 of U.S. Pat. No. 4,160,648) and 150 mL of anhydrous toluene. Triethylamine (6.41 mL) and 4-dimethylaminopyridine (0.54 grams) were then added and the resulting mixture was heated to reflux under nitrogen for 16 hours. The reaction was then cooled to room temperature and diluted with 300 mL of diethyl ether. The organic layer was washed twice with 1% aqueous hydrochloric acid, twice with saturated aqueous sodium bicarbonate solution, and once with saturated aqueous sodium chloride. The organic layer was then dried over anhydrous magnesium sulfate, filtered and the solvents removed in vacuo to yield 76.5 grams of a light brown oil. The oil was chromatographed on silica gel, eluting with hexane/diethyl ether/ethanol (8:1.5:0.5), to yield 43.2 grams of the desired product as a colorless oil.

Example 3

Preparation of α-(4-Hydroxybenzoyl)-ω-4-dodecylphenoxypoly(oxybutylene)

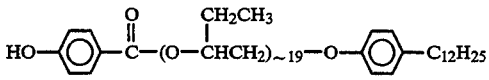

A solution of 15.9 grams of the product from Example 2 in 50 mL of ethyl acetate and 50 mL of acetic acid containing 3.48 grams of 5% palladium on charcoal was hydrogenolyzed at 35–40 psi for 16 hours on a Parr low-pressure hydrogenator. Catalyst filtration and removal of residual acetic acid with toluene in vacuo yielded 14.6 grams of the desired product as a colorless oil. The product had an average of 19 oxybutylene units. IR (neat) 1715 $cm^{-1}$; NMR ($CDCl_3$) δ7.9, 7.3 (AB quartet, 4H), 7.1–7.25 (m, 2H), 6.7–6.9 (m, 2H), 5.05–5.15 (m, 1H), 3.1–4.0 (m, 56H), 0.5–1.9 (m, 120H).

Similarly, by using the above procedures and the appropriate starting materials and reagents, the following compounds can by prepared:

α-(4-hydroxybenzoyl)-ω-n-butyloxypoly(oxybutylene);
α-(4-hydroxybenzoyl)-ω-4-t-butylphenoxypoly(oxybutylene);
α-(4-hydroxybenzoyl)-ω-4-octacosylphenoxypoly(oxybutylene);
α-(4-hydroxy-3-methoxybenzoyl)-ω-4-dodecylphenoxypoly(oxybutylene);
α-(4-hydroxy-3-methybenzoyl)-ω-4-dodecylphenoxypoly(oxybutylene); and
α-(3,4-dihydroxybenzoyl)-ω-4-dodecylphenoxypoly(oxybutylene).

Example 4

Preparation of

α-Hydroxybenzoyl)-ω-n-butoxypoly(oxypropylene).

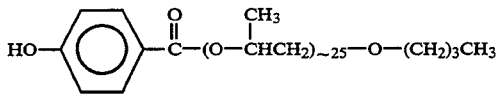

To a flask equipped with a magnetic stirrer, thermometer, Dean-Stark trap, nitrogen inlet and reflux condenser was added 4.52 grams of 4-hydroxybenzoic acid, 50.0 grams of α-hydroxy-ω-n-butoxypoly(oxypropylene) having an average of 25 oxypropylene units (commercially available from Union Carbide as LB385) and 0.56 grams of p-toluenesulfonic acid. The reaction was heated to 120° C. for 16 hours and then cooled to room temperature. Diethyl ether (750 mL) was added and the organic phase was washed twice with saturated aqueous sodium bicarbonate, and once with saturate aqueous sodium chloride solution. The organic layer was then dried over anhydrous magnesium sulfate, filtered and concentrated in vacuo to afford 51.7 grams of a brown oil. The oil was chromatographed on silica gel, eluting with hexane/ethyl acetate/ethanol (49:49:2) to yield 25.2 grams of the desired product as a yellow oil. The product had an average of 25 oxypropylene units. IR (neat) 1715 $cm^{-1}$; $^1H$ NMR ($CDCl_3$) δ7.9, 6.85 (AB quartet, 4H), 5.05–5.15 (m, 1H), 3.1∝4.0 (m, 76H), 1.4–1.6 (m, 2H), 1.25–1.4 (m, 2H), 0.9–1.4 (m, 75H), 0.75–0.9 (t, 3H).

Similarly, by using the above procedures and the appropriate starting materials and reagents, the following compounds can by prepared:

α-(4-hydroxybenzoyl)-ω-4-t-butylphenoxypoly(oxypropylene);

α-(4-hydroxybenzoyl)-ω-4-dodecylphenoxypoly(oxypropylene);

α-(4-hydroxy-3-methoxybenzoyl)-ω-n-butoxypoly(oxypropylene);

α-(4-hydroxy-3-methybenzoyl)-ω-n-butoxypoly(oxypropylene); and

α-(3,4-dihydroxybenzoyl)-ω-n-butoxypoly(oxybutylene).

Example 5

Preparation of 2-Benzyloxybenzoyl Chloride

To a flask equipped with a magnetic stirrer and drying tube was added 15.0 grams of 2-benzyloxybenzoic acid and 150 mL of anhydrous dichloromethane followed by 28.7 mL of oxalyl chloride. The reaction was stirred at room temperature for 16 hours, and then the solvent was removed in vacuo to yield 16.2 grams of the desired acid chloride.

Example 6

Preparation of

α-(2-Benzyloxybenzoyl)-ω-4-dodecylphenoxypoly(oxybutylene)

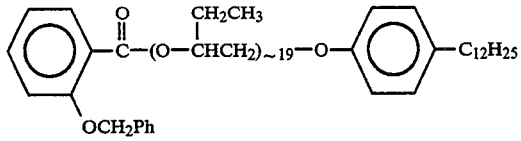

2-Benzyloxybenzoyl chloride (16.2 grams) from Example 5 was combined with 108.3 grams of α-hydroxy-ω-4-dodecylphenoxypoly(oxybutylene) having an average of 19 oxybutylene units (prepared essentially as described in Example 6 of U.S. Pat. No. 4,160,648) and 225 mL of anhydrous toluene. Triethylamine (9.6 mL) and 4-dimethylaminopyridine (0.8 grams) were added and the reaction was heated to reflux under nitrogen for 16 hours, then cooled to room temperature and diluted with 500 mL of diethyl ether. The organic layer was washed twice with 1% aqueous hydrochloric acid, twice with saturated aqueous sodium bicarbonate solution, and once with saturated aqueous sodium chloride. The organic layer was then dried over anhydrous magnesium sulfate, filtered and concentrated in vacuo to yield 119.2 grams of a light brown oil. The oil was chromatographed on silica gel, eluting with hexane/diethyl ether/ethanol (8:1.5:0.5) to yield 73.0 grams of the desired product as a light brown oil.

Example 7

Preparation of

α-(2-Hydroxybenzoyl)-ω-4-dodecylphenoxypoly(oxybutylene)

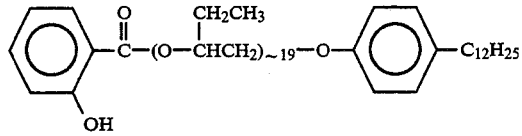

A solution of 30.8 grams of the product from Example 6 in 95 mL of ethyl acetate and 95 mL of acetic acid containing 3.39 grams of 10% palladium on charcoal was hydrogenolyzed at 35–40 psi for 16 hours on a Parr low-pressure hydrogenator. Catalyst filtration and removal of solvent in vacuo followed by azeotropic removal of residual acetic acid with toluene under vacuum yielded 28.9 grams of the desired product as a light brown oil. The product had an average of 19 oxybutylene units. IR (neat) 1673 $cm^{-1}$, $^1H$ NMR ($CDCl_3$) δ10.85 (s, 1H), 7.8–8.2 (m, 8H), 5.1–5.3 (m, 1H), 3.2–4.1 (m, 56H),0.5–1.9 (m, 21H).

Example 8

Preparation of
α-(3-Hydroxybenzoyl)-ω-4-dodecylphenoxypoly(oxybutylene)

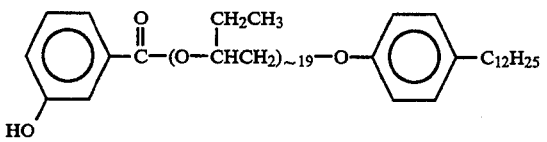

To a flask equipped with a magnetic stirrer, thermometer, Dean-Stark trap, nitrogen inlet and reflux condenser was added 5.08 grams of 3-hydroxybenzoic acid, 50.0 grams of α-hydroxy-ω-4-dodecylphenoxypoly(oxybutylene) having an average of 19 oxybutylene units (prepared essentially as described in Example 6 of U.S. Pat. No. 4,160,648) and 0.53 grams of p-toluenesulfonic acid. The reaction was heated to 130° C. for 48 hours and then cooled to room temperature. Diethyl ether (750 mL) was added and the organic phase was washed twice with saturated aqueous sodium bicarbonate and once with saturated aqueous sodium chloride solution. The organic layer was then dried over anhydrous magnesium sulfate, filtered and concentrated in vacuo to afford 47.8 grams of a brown oil. The oil was chromatographed on silica gel, eluting with hexane/ethyl acetate/ethanol (78:20:2) to yield 16.5 grams of the desired product as a yellow oil. The product had an average of 19 oxybutylene groups. IR (neat) 1716 $cm^{-1}$; $^1H$ NMR ($CDCl_3$) δ6.6–7.6 (m, 8H), 4.9–5.2 (m, 1H), 3.1–4.0 (m, 56H), 0.5–1.9 (m, 21H).

Example 9

Preparation of 3,5-Di-t-butyl-4 -hydroxybenzoyl Chloride

To a flask equipped with a magnetic stirrer, reflux condenser and nitrogen inlet was added 1.88 grams of 3,5-di-t-butyl-4-hydroxybenzoic acid and 15 mL of thionyl chloride. The reaction was refluxed for 2 hours and stirred at room temperature for 16 hours. The excess thionyl chloride was removed in vacuo to yield 2.2 grams of the desired acid chloride as a white solid.

Example 10

Preparation of
α-(3,5-Di-t-butyl-4-hydroxybenzoyl)-ω-4dodecylphenoxypoly(oxybutylene)

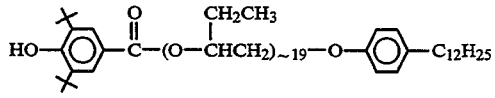

3,5-Di-t-butyl-4-hydroxybenzoyl chloride (2.2 grams) from Example 9 was combined with 13.6 grams of α-hydroxy-ω-4-dodecylphenoxy-poly(oxybutylene) having an average of 19 oxybutylene units (prepared essentially as described in Example 6 of U.S. Pat. No. 4,160,648) and 50 mL of anhydrous toluene. Triethylamine (1.17 mL) and 4-dimethylaminopyridine (0.1 grams) were added and the reaction was heated to reflux under nitrogen for 16 hours, and then cooled to room temperature and diluted with 100 mL of hexane. The organic layer was washed twice with water, once with saturated aqueous sodium bicarbonate solution and once with saturated aqueous sodium chloride. The organic layer was dried over anhydrous magnesium sulfate, filtered and concentrated in vacuo to give an oil. The oil was chromatographed on silica gel, eluting with hexane/diethyl ether/ethanol (6:3.5:0.5) to yield 3.0 grams of the desired product as a yellow oil. IR (neat) 1715 $cm^{-1}$; $^1H$ NMR ($CDCl_3$) δ7.8 (s, 2H), 7.1–7.25 (m, 2H), 6.7–6.9 (m, 2H), 5.7 (s, 1H), 7.1–7.25 (m, 2H), 6.7–6.9 (m, 2H), 5.7 (s, 1H), 5.05–5.15 (m, 1H), 3.1–4.0 (m, 56H), 0.5–1.9 (m, 38H).

Example 11

Preparation of
α-(3,5-Di-t-butyl-4-hydroxybenzoyl)-ω-n-butoxypoly(oxypropylene)

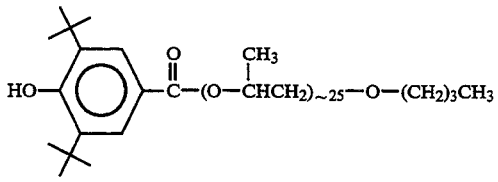

3,5-Di-t-butyl-4-hydroxybenzoyl chloride (8.0 grams) prepared as described in Example 9 was combined with 46.2 grams of α-hydroxy-ω-n-butoxypoly(oxypropylene) having an average of 25 oxypropylene units (commercially available from Union Carbide as LB385) and 200 mL of anhydrous toluene. Triethylamine (4.4 mL) and 4-dimethylaminopyridine (0.37 grams) were added and the reaction was heated to reflux under nitrogen for 16 hours, and then cooled to room temperature and diluted with 500 mL of hexane. The organic layer was washed twice with water, once with saturated aqueous sodium bicarbonate solution and once with saturated aqueous sodium chloride. The organic layer was dried over anhydrous magnesium sulfate, filtered and concentrated in vacuo to give an oil. The oil was chromatographed on silica gel, eluting with hexane/diethyl ether/ethanol (6:3.5:0.5) to yield 42.0 grams of the desired product as a yellow oil. The product had an average of 25 oxypropylene units. IR (neat) 1715 $cm^{-1}$; $^1H$ NMR ($CDCl_3$) δ7.8 (s, 2H), 5.7 (s, 1H), 5.05–5.15 (m, 1H), 3.2–3.9 (m, 75H), 0.9–1.6 (m, 97H), 0.75–0.9 (t, 3H).

Example 12

Preparation of
α-[(4-Hydroxyphenyl)acetyl)-ω-4-dodecylphenoxypoly(oxybutylene)

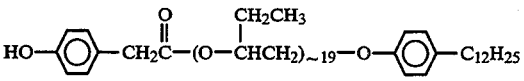

To a flask equipped with a magnetic stirrer, thermometer, Dean-Stark trap, nitrogen inlet and reflux condenser was added 4.66 grams of 4-hydroxyphenylacetic acid, 50.0 grams α-hydroxy-ω-4-dodecylphenoxypoly(oxybutylene) having an average of 19 oxybutylene units (prepared essentially as described in Example 6 of U.S. Pat. No. 4,160,648) and 0.63 grams of p-toluenesulfonic acid. The reaction was heated to 120° C. for 16 hours and then cooled to room temperature. Diethyl ether (750 mL) was added and the organic phase was washed twice with saturated aqueous sodium bicarbonate, and then once with saturated aqueous sodium chloride solution. The organic layer was dried over anhydrous magnesium sulfate, filtered and concentrated in vacuo to afford 51.6 grams of a brown oil. The oil was chromatographed on silica gel, eluting with hexane/ethyl acetate/ethanol (93:5:2) to yield 26.2 grams of the desired product as a yellow oil. The product had an average of 19 oxybutylene units. IR (neat) 1742 $cm^{-1}$; $^1H$ NMR ($CDCl_3$) δ6.7–7.25 (m, 8H), 4.8–5.0 (m, 1H), 3.1–4.05 (m, 58H), 0.5–1.9 1.9 (m, 120H).

Example 13

Preparation of
α-[3-(4-Hydroxyphenyl)propionyl)-ω-4-dodecylphenoxypoly(oxybutylene)

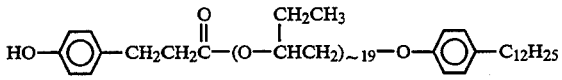

To a flask equipped with a magnetic stirrer, thermometer, Dean-Stark trap, nitrogen inlet and reflux condenser was added 5.09 grams of 3-(4-hydroxyphenyl)propionic acid, 50.0 grams of α-hydroxy-ω-4-dodecylphenoxypoly(oxybutylene) having an average of 19 oxybutylene units (prepared essentially as described in Example 6 of U.S. Pat. No. 4,160,648) and 0.63 grams of p-toluenesulfonic acid. The reaction was heated to 120° C. for 16 hours and then cooled to room temperature. Diethyl ether (750 mL) was added and the organic phase was washed twice with saturated aqueous sodium bicarbonate, and once with saturated aqueous sodium chloride solution. The organic layer was dried over anhydrous magnesium sulfate, filtered and concentrated in vacuo to afford 52.7 grams of a brown oil. The oil was chromatographed on silica gel, eluting with hexane/ethyl acetate/ethanol (93:5:2) to yield 37.5 grams of the desired product as a yellow oil. IR (neat) 1735 $cm^{-1}$; $^1H$ NMR ($CDCl_3$) δ6 7–7.25 (m, 8H), 4.8–5.0 (m, 1H), 3.1–4.05 (m, 56H), 2.9 (t, 2H), 2.55 (t, 2H), 0.5–0.9 (m, 120H).

Example 14

Preparation of
α-Benzyloxy-ω-4-hydroxypoly(oxybutylene)

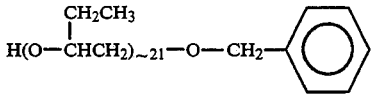

To a flask equipped with a mechanical stirrer, thermometer, addition funnel, reflux condenser and nitrogen inlet was added 1.59 grams of a 35 wt. % dispersion of potassium hydride in mineral oil. Benzyl alcohol (5 grams) dissolved in 250 mL of anhydrous toluene was added dropwise. After hydrogen evolution had subsided, the reaction was heated to reflux for 3 hours and then cooled to room temperature. 1,2-Epoxybutane (99.6 mL) were then added dropwise and the reaction was refluxed for 16 hours. The reaction was cooled to room temperature, quenched with 5 mL of methanol and diluted with 500 mL of diethyl ether. The resulting mixture was washed with saturated aqueous ammonium chloride, followed by water and saturated aqueous sodium chloride. The organic layer was dried over anhydrous magnesium sulfate, filtered and the solvents removed in vacuo to yield 64.1 grams of a yellow oil. The oil was chromatographed on silica gel, eluting with hexane/ethyl acetate/ethanol (90:8:2) to afford 40 grams of the desired product as a light yellow oil.

Example 15

Preparation of
α-(4-Benzyloxybenzoyl)-ω-benzyloxypoly(oxybutylene)

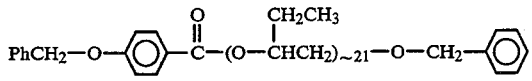

4-Benzyloxybenzoyl chloride (10.8 grams) from Example 1 was combined with α-benzyloxy-ω-hydroxypoly(oxybutylene) (15.0 grams) from Example 14 and 50 mL of anhydrous toluene. Triethylamine (1.3 mL) and 4-dimethylaminopyridine (0.55 grams) were then added and the resulting mixture was heated to reflux under nitrogen for 16 hours. The reaction was then cooled to room temperature and diluted with 100 mL of diethyl ether. The organic layer was washed twice with 1% aqueous hydrochloric acid, twice with saturated aqueous sodium bicarbonate solution, and once with saturated aqueous sodium chloride. The organic layer was then dried over anhydrous magnesium sulfate, filtered and the solvents removed in vacuo to yield 16.8 grams of the desired product as a yellow oil.

Example 16

Preparation of
α-(4-Hydroxybenzoyl)-ω-hydroxypoly(oxybutylene)

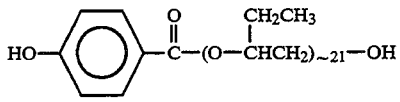

A solution of 16.8 grams of the product from Example 15 in 100 mL of ethyl acetate and 100 mL of acetic acid containing 3.0 grams of 5% palladium on charcoal was hydrogenolyzed at 35–40 psi for 16 hours on a Parr low-pressure hydrogenator. Catalyst filtration and removal of residual acetic acid with toluene in vacuo yielded 14.8 grams of the desired product as a yellow oil. The product had an average of 21 oxybutylene units. IR (neat) 1715 $cm^{-1}$; $^1H$ NMR ($CDCl_3$) δ7.9, 6.8 (AB quartet, 4H), 5.05–5.15 (m, 1H), 3.1–3.9 (m, 62H), 0.6–1.9 (m, 105H).

Example 17

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200° F.; vacuum of 12 in Hg, air-fuel ratio of 12, ignition spark timing of 40° BTC; engine speed is 1800 rpm; the crankcase oil is a commercial 30W oil.

The amount of carbonaceous deposit in milligrams on the intake valves is reported for each of the test compounds in

TABLE I

| Sample[1] | Intake Valve Deposit Weight (in milligrams) Run 1 | Run 2 | Average |
|---|---|---|---|
| Base Fuel | 214.7 | 193.7 | 204.2 |
| Example 3 | 7.1 | 9.1 | 8.1 |
| Example 4 | 127.7 | 128.4 | 128.1 |
| Example 7 | 150.0 | 215.4 | 182.7 |
| Example 8 | 62.3 | 57.5 | 59.9 |
| Example 10 | 108.0 | 95.1 | 101.6 |
| Example 11 | 117.1 | 124.6 | 120.9 |
| Example 12 | 84.6 | 98.4 | 91.5 |
| Example 13 | 90.5 | 90.7 | 90.6 |
| Example 16 | 41.1 | 43.0 | 42.1 |

[1]At 200 parts per million actives (ppma).

The base fuel employed in the above single-cylinder engine tests was a regular octane unleaded gasoline containing no fuel detergent. The test compounds were admixed with the base fuel to give a concentration of 200 ppma (parts per million actives).

The data in Table I illustrates the significant reduction in intake valve deposits provided by the poly(oxyalkylene) hydroxyaromatic ester component of the present fuel additive composition (Examples 3, 4, 7, 8, 10, 11, 12, 16) compared to the base fuel.

Example 18

Multicylinder Engine Test

The fuel additive composition of the present invention was tested in a laboratory multicylinder engine to evaluate their intake valve and combustion chamber deposit control performance. The test engine was a 4.3 liter, TBI (throttle body injected), V6 engine manufactured by General Motors Corporation. The major engine dimensions are set forth in Table II:

TABLE II

| Enqine Dimensions | |
|---|---|
| Bore | 10.16 cm |
| Stroke | 8.84 cm |
| Displacement Volume | 4.3 liter |
| Compression Ratio | 9.3:1 |

The test engine was operated for 40 hours (24 hours a day) on a prescribed load and speed schedule representative of typical driving conditions. The cycle for engine operation during the test is set forth in Table III.

TABLE III

| Step | Mode | Engine Driving Cycle: Time in Mode [Sec][1] | Dynamometer Load [kg] | Engine Speed [RPM] |
|---|---|---|---|---|
| 1 | Idle | 60 | 0 | 800 |
| 2 | City Cruise | 150 | 10 | 1,500 |
| 3 | Acceleration | 40 | 25 | 2,800 |
| 4 | Heavy HWY Cruise | 210 | 15 | 2,200 |
| 5 | Light HWY Cruise | 60 | 10 | 2,200 |
| 6 | Idle | 60 | 0 | 800 |
| 7 | City Cruise | 180 | 10 | 1,500 |

TABLE III-continued

| Step | Mode | Engine Driving Cycle: Time in Mode [Sec][1] | Dynamometer Load [kg] | Engine Speed [RPM] |
|---|---|---|---|---|
| 8 | Idle | 60 | 0 | 800 |

[1]All steps, except step number 3, include a 15 second transition ramp. Step 3 includes a 20 second transition ramp.

All of the test runs were made with the same base gasoline, which was representative of commercial unleaded fuel. The results are set forth in Table IV.

TABLE IV

| Sample | Multicylinder Engine Test Results: Conc. (ppma) | Intake Valve Deposits[1] | Combustion Chamber Deposits[1] |
|---|---|---|---|
| Base Fuel | — | 972 | 1902 |
| Poly(oxyalkylene) Hydroxyaromatic Ester[2] | 400 | 48 | 2189 |
| Poly(oxyalkylene) Amine[3] | 200 | 340 | 2282 |
| Poly(oxyalkylene) Hydroxyaromatic Ester/ Poly(oxyalkylene) Amine[4] | 400/200 | 17 | 1954 |

[1]Average of two runs, in milligrams (mg).
[2]α-(4-Hydroxybenzoyl)-ω-4-dodecylphenoxy-poly(oxybutylene) prepared as described in Example 3.
[3]Dodecylphenyl poly(oxyalkylene) ethylene diamine carbamate prepared essentially as described in Examples 6-8 of U.S. Pat. No. 4,160,648.
[4]Mixture of 400 ppm of α-(4-Hydroxybenzoyl)-ω-4-dodecylphenoxypoly(oxybutylene) and 200 ppm of dodecylphenyl poly(oxyalkylene) ethylene diamine carbamate.

The base fuel employed in the above multicylinder engine tests contained no fuel detergent. The test compounds were admixed with the base fuel at the indicated concentrations.

The data in Table IV demonstrates that the combination of a poly(oxyalkylene) hydroxyaromatic ester and a poly(oxyalkylene) amine has a synergistic effect and gives significantly better intake valve deposit control than either component individually, Moreover, the data in Table IV further demonstrates that the combination produces fewer combustion chamber deposits than each individual component.

What is claimed is:

1. A fuel additive composition comprising:

(a) a poly(oxyalkylene) hydroxyaromatic ester having the formula:

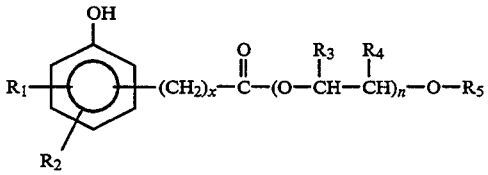

or a fuel-soluble salt thereof; wherein $R_1$ and $R_2$ are each independently hydrogen, hydroxy, lower alkyl having 1 to 6 carbon atoms, or lower alkoxy having 1 to 6 carbon atoms;

$R_3$ and $R_4$ are each independently hydrogen or lower alkyl having 1 to 6 carbon atoms;

$R_5$ is hydrogen, alkyl having 1 to 30 carbon atoms, phenyl, aralkyl or alkaryl having 7 to 36 carbon atoms, or an acyl group having the formula:

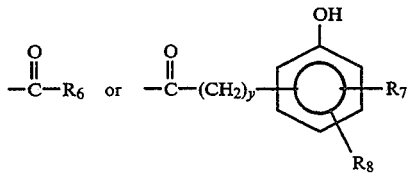

wherein $R_6$ is alkyl having 1 to 30 carbon atoms, phenyl, or aralkyl or alkaryl having 7 to 36 carbon atoms; $R_7$ and $R_8$ are each independently hydrogen, hydroxy, lower alkyl having 1 to 6 carbon atoms, or lower alkoxy having 1 to 6 carbon atoms; n is an integer from 5 to 100; and x and y are each independently an integer from 0 to 10; and (b) a poly(oxyalkylene) amine having at least one basic nitrogen atom and a sufficient number of oxyalkylene units to render the poly(oxyalkylene) amine soluble in hydrocarbons boiling in the gasoline or diesel range.

2. The fuel additive composition according to claim 1, wherein n of said poly(oxyalkylene) hydroxyaromatic ester is an integer ranging from 10 to 50.

3. The fuel additive composition according to claim 2, wherein n of said poly(oxyalkylene) hydroxyaromatic ester is an integer ranging from 15 to 30.

4. The fuel additive composition according to claim 2, wherein $R_1$ of said poly(oxyalkylene) hydroxyaromatic ester is hydrogen, hydroxy, or lower alkyl having 1 to 4 carbon atoms; and $R_2$ is hydrogen.

5. The fuel additive composition according to claim 4, wherein $R_5$ of said poly(oxyalkylene) hydroxyaromatic ester is hydrogen, alkyl having 2 to 22 carbon atoms, or alkylphenyl having an alkyl group containing 4 to 24 carbon atoms.

6. The fuel additive composition according to claim 5, wherein $R_1$ of said poly(oxyalkylene) hydroxyaromatic ester is hydrogen or hydroxy.

7. The fuel additive composition according to claim 6, wherein $R_5$ of said poly(oxyalkylene) hydroxyaromatic ester is hydrogen, alkyl having 4 to 12 carbon atoms, or alkylphenyl having an alkyl group containing 4 to 12 carbon atoms.

8. The fuel additive composition according to claim 7, wherein one of $R_3$ and $R_4$ of said poly(oxyalkylene) hydroxyaromatic ester is lower alkyl having 1 to 3 carbon atoms and the other is hydrogen.

9. The fuel additive composition according to claim 8, wherein one of $R_3$ and $R_4$ of said poly(oxyalkylene) hydroxyaromatic ester is methyl or ethyl and the other is hydrogen.

10. The fuel additive composition according to claim 9, wherein x of said poly(oxyalkylene) hydroxyaromatic ester is 0, 1 or 2.

11. The fuel additive composition according to claim 10, wherein $R_1$ of said poly(oxyalkylene) hydroxyaromatic ester is hydrogen, $R_5$ is alkylphenyl having an alkyl group containing 4 to 12 carbon atoms, and x is 0.

12. The fuel additive composition according to claim 1, wherein said poly(oxyalkylene) amine has a molecular weight in the range of about 500 to about 10,000.

13. The fuel additive composition according to claim 1, wherein said poly(oxyalkylene) amine contains at least about 5 oxyalkylene units.

14. The fuel additive composition according to claim 1, wherein said poly(oxyalkylene) amine is a hydrocarbyl poly(oxyalkylene) polyamine.

15. The fuel additive composition according to claim 1, wherein said poly(oxyalkylene) amine is a poly(oxyalkylene) polyamine, wherein the poly(oxyalkylene) moiety is connected to the polyamine moiety through an oxyalkylene hydroxy linkage.

16. The fuel additive composition according to claim 1, wherein said poly(oxyalkylene) amine is a branched alkyl poly(oxyalkylene) monoamine, wherein the branched alkyl group is derived from the alcohol product of a Guerbet condensation reaction, said alcohol product having the formula:

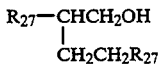

wherein $R_{27}$ is a hydrocarbyl chain.

17. The fuel additive composition according to claim 1, wherein said poly(oxyalkylene) amine is a hydrocarbyl poly(oxyalkylene) aminocarbamate.

18. The fuel additive composition according to claim 17, wherein the hydrocarbyl group of said hydrocarbyl poly(oxyalkylene) aminocarbamate contains from 1 to about 30 carbon atoms.

19. The fuel additive composition according to claim 18, wherein said hydrocarbyl group of said hydrocarbyl poly(oxyalkylene) aminocarbamate is an alkylphenyl group.

20. The fuel additive composition according to claim 19, wherein the alkyl moiety of said alkylphenyl group is tetrapropenyl.

21. The fuel additive composition according to claim 17, wherein the amine moiety of said hydrocarbyl poly(oxyalkylene) aminocarbamate is derived from a polyamine having from 2 to 12 amine nitrogen atoms and from 2 to 40 carbon atoms.

22. The fuel additive composition according to claim 21, wherein said polyamine is a polyalkylene polyamine having 2 to 12 amine nitrogen atoms and 2 to 24 carbon atoms.

23. The fuel additive composition according to claim 22, wherein said polyalkylene polyamine is selected from the group consisting of ethylenediamine, propylenediamine, diethylenetriamine and dipropylenetriamine.

24. The fuel additive composition according to claim 17, wherein the poly(oxyalkylene) moiety of said hydrocarbyl poly(oxyalkylene) aminocarbamate is derived from $C_2$ to $C_5$ oxyalkylene units.

25. The fuel additive composition according to claim 17, wherein said hydrocarbyl poly(oxyalkylene) aminocarbamate is an alkylphenyl poly(oxybutylene) aminocarbamate, wherein the amine moiety is derived from ethylenediamine or diethylenetriamine.

26. A fuel composition comprising a major amount of hydrocarbons boiling in the gasoline or diesel range and an effective detergent amount of a fuel additive composition comprising:

(a) a poly(oxyalkylene) hydroxyaromatic ester having the formula:

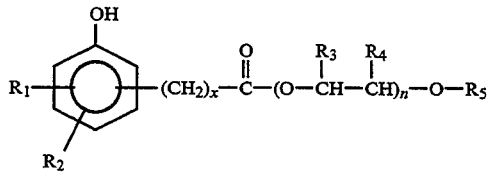

or a fuel-soluble salt thereof; wherein $R_1$ and $R_2$ are each independently hydrogen, hydroxy, lower alkyl having 1 to 6 carbon atoms, or lower alkoxy having 1 to 6 carbon atoms;

$R_3$ and $R_4$ are each independently hydrogen or lower alkyl having 1 to 6 carbon atoms;

$R_5$ is hydrogen, alkyl having 1 to 30 carbon atoms, phenyl, aralkyl or alkaryl having 7 to 36 carbon atoms, or an acyl group having the formula:

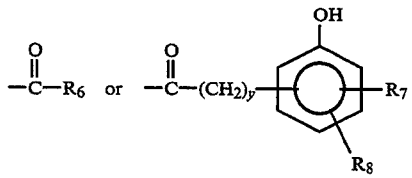

wherein $R_6$ is alkyl having 1 to 30 carbon atoms, phenyl, or aralkyl or alkaryl having 7 to 36 carbon atoms; $R_7$ and $R_8$ are each independently hydrogen, hydroxy, lower alkyl having 1 to 6 carbon atoms, or lower alkoxy having 1 to 6 carbon atoms; n is an integer from 5 to 100; and x and y are each independently an integer from 0 to 10; and (b) a poly(oxyalkylene) amine having at least one basic nitrogen atom and a sufficient number of oxyalkylene units to render the poly(oxyalkylene) amine soluble in hydrocarbons boiling in the gasoline or diesel range.

27. The fuel composition according to claim 26, wherein $R_1$ of said poly(oxyalkylene) hydroxyaromatic ester is hydrogen, hydroxy, or lower alkyl having 1 to 4 carbon atoms; $R_2$ is hydrogen; one of $R_3$ and $R_4$ is hydrogen and the other is methyl or ethyl; $R_5$ is hydrogen, alkyl having 2 to 22 carbon atoms, or alkylphenyl having an alkyl group containing 4 to 24 carbon atoms; n is 15 to 30 and x is 0, 1 or 2.

28. The fuel composition according to claim 27, wherein $R_1$ of said poly(oxyalkylene) hydroxyaromatic ester is hydrogen or hydroxy; $R_5$ is hydrogen, alkyl having 4 to carbon atoms, or alkylphenyl having an alkyl group containing 4 to 12 carbon atoms; and x is 0.

29. The fuel composition according to claim 28, wherein $R_1$ of said poly(oxyalkylene) ester is hydrogen, and $R_5$ is alkylphenyl having an alkyl group containing 4 to 12 carbon atoms.

30. The fuel composition according to claim 26, wherein said poly(oxyalkylene) amine is a hydrocarbyl poly(oxyalkylene) aminocarbamate.

31. The fuel composition according to claim 30, wherein the hydrocarbyl group of said hydrocarbyl poly(oxyalkylene) aminocarbamate contains from 1 to about 30 carbon atoms; and wherein the amine moiety of said hydrocarbyl poly(oxyalkylene) aminocarbamate is derived from a polyamine having from 2 to 12 amine nitrogen atoms and from 2 to 40 carbon atoms.

32. The fuel composition according to claim 31, wherein said hydrocarbyl group of said hydrocarbyl poly(oxyalkylene) aminocarbamate is an alkylphenyl group; and wherein said polyalkylene polyamine is selected from the group consisting of ethylenediamine, propylenediamine, diethylenetriamine and dipropylenetriamine.

33. The fuel composition according to claim 32, wherein the alkyl moiety of said alkylphenyl group is tetrapropenyl.

34. The fuel composition according to claim 30, wherein said hydrocarbyl poly(oxyalkylene) aminocarbamate is an alkylphenyl poly(oxybutylene) aminocarbamate, wherein the amine moiety is derived from ethylenediamine or diethylenetriamine.

35. The fuel composition according to claim 26, wherein said composition contains about 50 to about 2,500 parts per million by weight of said poly(oxyalkylene) hydroxyaromatic ester and about 25 to about 1,000 parts per million of said poly(oxyalkylene) amine.

36. A fuel concentrate comprising an inert stable oleophilic organic solvent boiling in the range of from about 150° F. to 400° F. and from about 10 to about 70 weight percent of a fuel additive composition comprising:

(a) a poly(oxyalkylene) hydroxyaromatic ester having the formula:

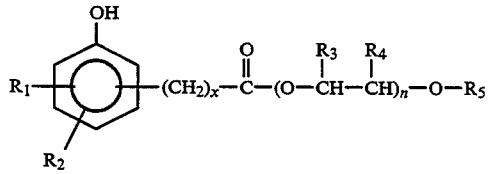

or a fuel-soluble salt thereof; wherein $R_1$ and $R_2$ are each independently hydrogen, hydroxy, lower alkyl having 1 to 6 carbon atoms, or lower alkoxy having 1 to 6 carbon atoms;

$R_3$ and $R_4$ are each independently hydrogen or lower alkyl having 1 to 6 carbon atoms;

$R_5$ is hydrogen, alkyl having 1 to 30 carbon atoms, phenyl, aralkyl or alkaryl having 7 to 36 carbon atoms, or an acyl group having the formula:

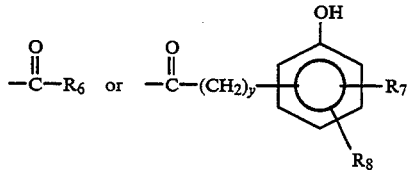

wherein $R_6$ is alkyl having 1 to 30 carbon atoms, phenyl, or aralkyl or alkaryl having 7 to 36 carbon atoms; $R_7$ and $R_8$ are each independently hydrogen, hydroxy, lower alkyl having 1 to 6 carbon atoms, or lower alkoxy having 1 to 6 carbon atoms;

n is an integer from 5 to 100; and x and y are each independently an integer from 0 to 10; and (b) a poly(oxyalkylene) amine having at least one basic nitrogen atom and a sufficient number of oxyalkylene units to render the poly(oxyalkylene) amine soluble in hydrocarbons boiling in the gasoline or diesel range.

37. The fuel concentrate according to claim 36, wherein $R_1$ of said poly(oxyalkylene) hydroxyaromatic ester is hydrogen, hydroxy, or lower alkyl having 1 to 4 carbon atoms; $R_2$ is hydrogen; one of $R_3$ and $R_4$ is hydrogen and the other is methyl or ethyl; $R_5$ is hydrogen, alkyl having 2 to 22 carbon atoms, or alkylphenyl having an alkyl group containing 4 to 24 carbon atoms; n is 15 to 30 and x is 0, 1 or 2.

38. The fuel concentrate according to claim 37, wherein $R_1$ of said poly(oxyalkylene) hydroxyaromatic ester is hydrogen or hydroxy; $R_5$ is hydrogen, alkyl having 4 to 12 carbon atoms, or alkylphenyl having an alkyl group containing 4 to 12 carbon atoms; and x is 0.

39. The fuel concentrate according to claim 38, wherein $R_1$ of said poly(oxyalkylene) hydroxyaromatic ester is hydrogen, and $R_5$ is alkylphenyl having an alkyl group containing 4 to 12 carbon atoms.

40. The fuel concentrate according to claim 36, wherein said poly(oxyalkylene) amine is a hydrocarbyl poly(oxyalkylene) aminocarbamate.

41. The fuel concentrate according to claim 40, wherein the hydrocarbyl group of said hydrocarbyl poly(oxyalkylene) aminocarbamate contains from 1 to about 30 carbon atoms; and wherein the amine moiety of said hydrocarbyl poly(oxyalkylene) aminocarbamate is derived from a polyamine having from 2 to 12 amine nitrogen atoms and from 2 to 40 carbon atoms.

42. The fuel concentrate according to claim 41, wherein said hydrocarbyl group of said hydrocarbyl poly(oxyalkylene) aminocarbamate is an alkylphenyl group; and wherein said polyalkylene polyamine is selected from the group consisting of ethylenediamine, propylenediamine, diethylenetriamine and dipropylenetriamine.

43. The fuel concentrate according to claim 42, wherein the alkyl moiety of said alkylphenyl group is tetrapropenyl.

44. The fuel concentrate according to claim 40, wherein said hydrocarbyl poly(oxyalkylene) aminocarbamate is an alkylphenyl poly(oxybutylene) aminocarbamate, wherein the amine moiety is derived from ethylenediamine or diethylenetriamine.

* * * * *